United States Patent [19]

Paul

[11] Patent Number: 4,531,470

[45] Date of Patent: Jul. 30, 1985

[54] MOORING LINE COUPLER

[76] Inventor: William A. Paul, 2338 Townley Rd., Toledo, Ohio 43614

[21] Appl. No.: 591,964

[22] Filed: Mar. 21, 1984

[51] Int. Cl.[3] ..... B63B 21/00

[52] U.S. Cl. ..... 114/230; 114/218

[58] Field of Search ..... 114/230, 249, 250, 251, 114/252, 218; 24/115 K

[56] References Cited

U.S. PATENT DOCUMENTS

| | | | |
|---|---|---|---|
| 18,107 | 9/1857 | Seaman | 114/252 |
| 3,134,154 | 5/1964 | Smith et al. | 114/230 |
| 3,196,824 | 7/1965 | Howard | 114/230 |
| 4,079,690 | 3/1978 | Paul | 114/230 |

FOREIGN PATENT DOCUMENTS

| | | | |
|---|---|---|---|
| 978682 | 12/1964 | United Kingdom | 114/249 |

*Primary Examiner*—Jesus D. Sotelo
*Attorney, Agent, or Firm*—Allen D. Gutchess, Jr.

[57] ABSTRACT

A mooring line coupler connects a mooring line from a dock or mooring post to a boat and releases the mooring line from the boat from a remote location on the boat. The coupler includes a cleat mounted on the boat with the cleat having a rotatable bar carrying a projection at an intermediate portion thereof. The projection engages the mooring line when in a first position and releases the mooring line when in a second position. A releasable latch engages and holds the projection when the latch is in a first position and the projection is in the first position. The latch has a second position spaced from the projection to enable it to move to the second position. The latch is moved from the first position toward the second position by remote controls which can be located at an operator's station.

8 Claims, 5 Drawing Figures

MOORING LINE COUPLER

This invention relates to a mooring line coupler for connecting a mooring line to a boat and for releasing the line.

Even small boats can be difficult to release from their mooring lines when an operator or pilot wishes to cast off from the mooring unit, e.g. a dock or mooring post. Particularly when wind or waves are present, the boat may swing away when some mooring lines are released so that the boat may be out of the desired position when the last of the lines are released. Further, when the last line is released, the boat may be blown or pushed by the waves toward the shore and be in excessively shallow water by the time the operator can start or control the propelling means to place the boat under power and direct it away from the dock or mooring area.

The present invention provides a line coupler which enables a mooring line to be connected to a boat and enables the pilot or operator to uncouple or release the line from a position at which he has control of the boat or the propelling means therefor. A line coupling assembly for accomplishing this purpose is shown in my U.S. Pat. No. 4,079,690, issued on Mar. 21, 1978. While that coupling assembly is functional, it tends to be rather large and cumbersome in practice. it also requires that the mooring line have a projection connected to it. While this has presented little problem when the boat is at a home port, the mooring lines elsewhere may not be so equipped.

The present invention provides a mooring line coupler which, in a preferred form, is in the form of a cleat having a bar which is rotatably supported in mounting posts on the deck or other surface of a boat. The rotatable bar has a projection at an intermediate portion which has a first position in which it engages a loop of a mooring line and a second position in which it releases the mooring line. A spring engaged with the rod urges the projection from the first position toward the second position. A latch associated with the bracket has a first position in which it engages and holds the projection in the first position. The latch also has a second position in which it is spaced from the projection, enabling the projection to move toward the second position. Electrically-operated means, preferably in the form of a solenoid, is located below the deck or within the boat behind the bracket with the solenoid being effective to move the latch to the position spaced from the projection when the solenoid is actuated. Actuation of the solenoid is controlled by a switch located at the pilot station or similar location so that the pilot or operator can release the mooring lines from that position where he has full control of the boat. With the solenoid located below the deck or behind the surface on which the cleat is mounted, that portion of the coupler exposed can be of a size which is no bigger than a conventional cleat. Further, the coupler is capable of being used with a conventional mooring line having the usual loop spliced into the end thereof.

It is, therefore, a principal object of the invention to provide more compact apparatus for facilitating the connecting to and releasing of a boat from a mooring unit.

Another object of the invention is to provide a mooring line coupler which can be used with a conventional mooring line having a loop in the end thereof.

A further object of the invention is to provide a mooring line coupler having a loop engaging member mounted on a surface of a boat and remotely controlled means for releasing the member mounted behind or below the surface of the boat whereby part of the overall coupler is concealed.

Many other objects and advantages of the invention will be apparent from the following detailed description of preferred embodiments thereof, reference being made to the accompanying drawings, in which.

Figure 1:
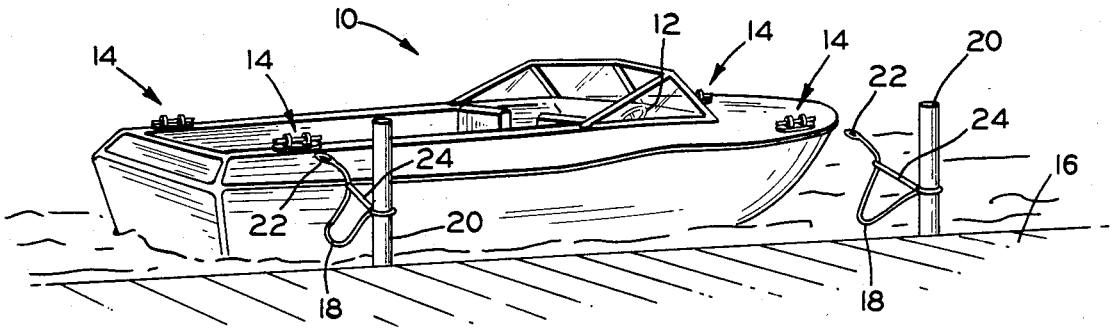
FIG. 1 is a view in perspective of a boat and a dock having posts carrying mooring lines which are connectable by couplers to the boat in accordance with the invention.

Referring to FIG. 1, a boat utilizing the invention is indicated at 10 and is shown as an inboard type with a steering wheel 12 by which the boat can be steered and controlled. The invention can also be used advantageously with boats having other drive or propelling means, including inboard-outboard units, outboards, and even sails. The invention can be used even more advantageously with larger boats, particularly with a one-man crew or a small crew. The boat, as shown, has four cleats 14 with which the boat can be moored to a mooring unit in the form of a dock 16 or the like.

Mooring lines 18 are shown as each having one end connected to a dock post or mooring post 20, the end encircling the post. The opposite end of each of the lines 18 has a loop 22 spliced therein. In a preferred form, each of the mooring lines 18 preferably has a resilient elongate strap 24 connected to spaced portions thereof and placed under tension when the line is connected to the boat 10. When the line is released, the strap 24 aids in holding the line, at least in part, above the water.

Figure 2:
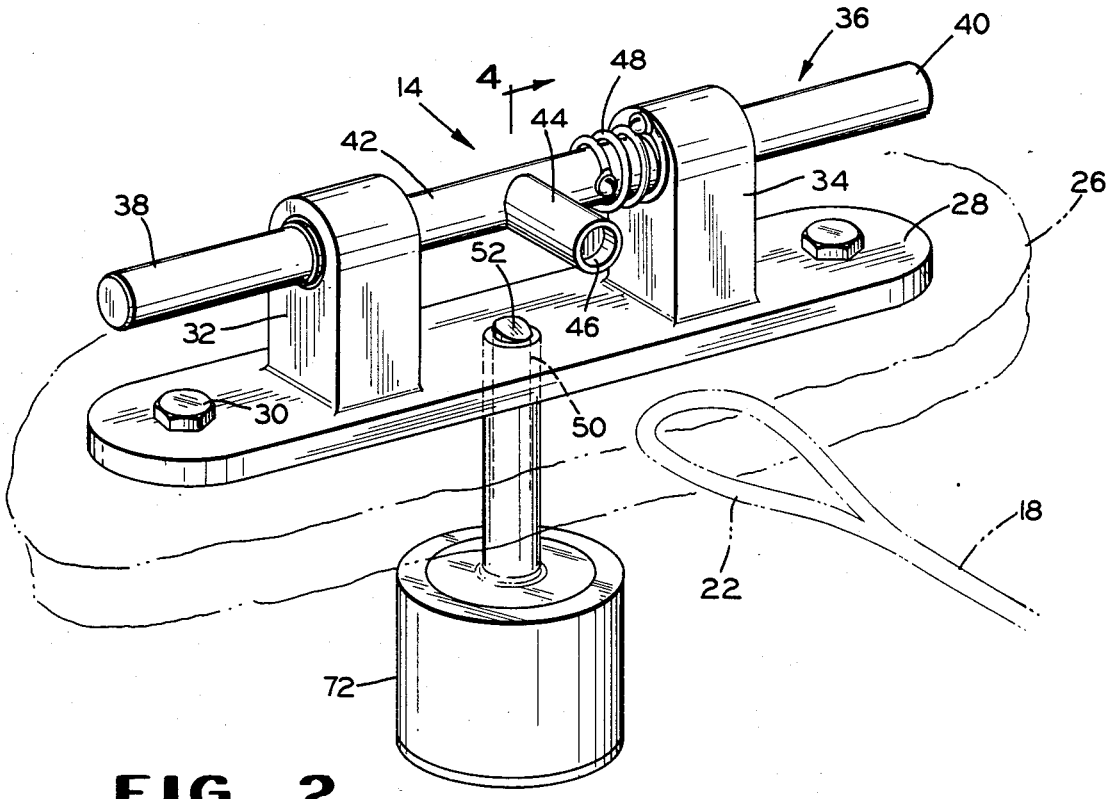
FIG. 2 is a view in perspective of one of the couplers of FIG. 1 with an engagable member in a released position.
Figure 3:
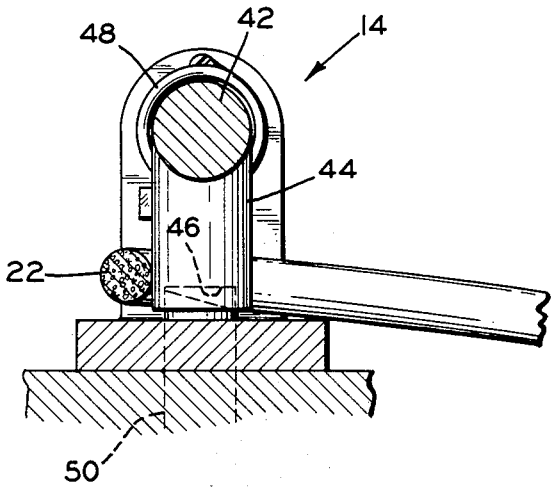
FIG. 3 is a view in transverse cross section taken through the coupler of FIG. 2 and showing an engagable member or projection in an engaged position with a mooring line.
Figure 4:
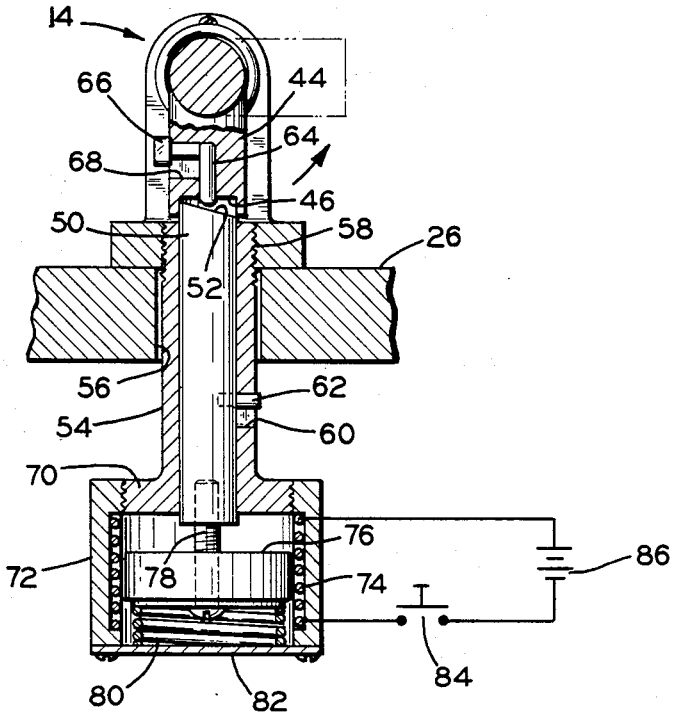
FIG. 4 is a view in transverse cross section taken along the line 4—4 of FIG. 2.

Referring to FIGS. 2–4, each of the cleats 14 is mounted on a deck 26 or other outer surface of the boat, having a base or mounting plate 29 fastened thereto by suitable fasteners or screws 30. Two spaced mounting posts 32 and 34 extend upwardly from the base 28 and rotatably support a bar 36 which has outer portions 38 and 40 extending outwardly beyond the posts 32 and 34, with an intermediate portion 42 between the posts. A connecting member of projection 44 extends outwardly from the intermediate portion 42 of the bar 36 and is functionally integral therewith. The projection 44 has a length such that the outer end extends close to the base 28 when in a vertical position with the outer end having a recess 46. A torsion spring 48 or other suitable means urges the projection 44 toward a generally horizontal position, as shown in FIG. 2, the spring being affixed to the post 34 and the bar 36. In this position, the projection can release the mooring line 18, being free of the loop 22.

When the projection 44 is in the vertical position and extends through the loop 22 of the line 18, a latch rod 50 has an upper slanted end 52 which extends into the recess 46 to hold the projection in this position. The latch rod 50 is mounted for vertical movement in a tubular housing 54 which extends through a hole 56 in the deck 26 and has an upper threaded end 58 affixed to the cleat base 28. The housing 54 has a slot 60 through which a transverse pin 62 of the latch rod 50 extends to maintain the latch rod oriented so that the slanted end 52 can force the latch rod 50 downwardly when the projection 44 is moved from the horizontal release position to the vertical, connecting position. The latch rod 50 can be manually pushed downwardly to release the projection 44 by a vertical pin 64 centrally located in the projection and having a transverse handle 66 extending outwardly therefrom through a slot 68 in the projection. A crew member can then push the handle 66 downwardly until the pin 64 moves the latch rod 50 downwardly sufficiently to clear the recess 46 in the projection, at which time the projection can move to the release position to release the mooring line 18.

The lower end of the tubular housing 54 can have a threaded flange 70 thereon which receives a solenoid housing 72. A solenoid coil 74 is positioned in the housing 72 around a solenoid core 76 which is affixed to the lower end of the latch rod 50 by a suitable fastener 78. A coil spring 80 below the core 76 is maintained under compression between the core 76 and a lower end cover 82 of the housing 72 and urges the rod 50 upwardly toward its latched position when the solenoid coil 74 is unactuated. The coil 74 is actuated when a remotely located switch 84 is closed to complete a circuit through a power source 86. The switch 84 can be remotely located at the pilot's station near the steering wheel 12 and the engine controls where the pilot can have complete control of the boat when it is cast off from the dock 16. When the coil 74 is actuated, the core 76 is drawn downwardly against the force of the spring 80 to hold the latch rod 50 downwardly in a release position with the slanted end 52 withdrawn from the recess 46. The projection 44 then swings to its release position under the force of the torsion spring 48 to release the loop 22 and the line 18 with the strap 24 helping to withdraw the loop.

Figure 5:
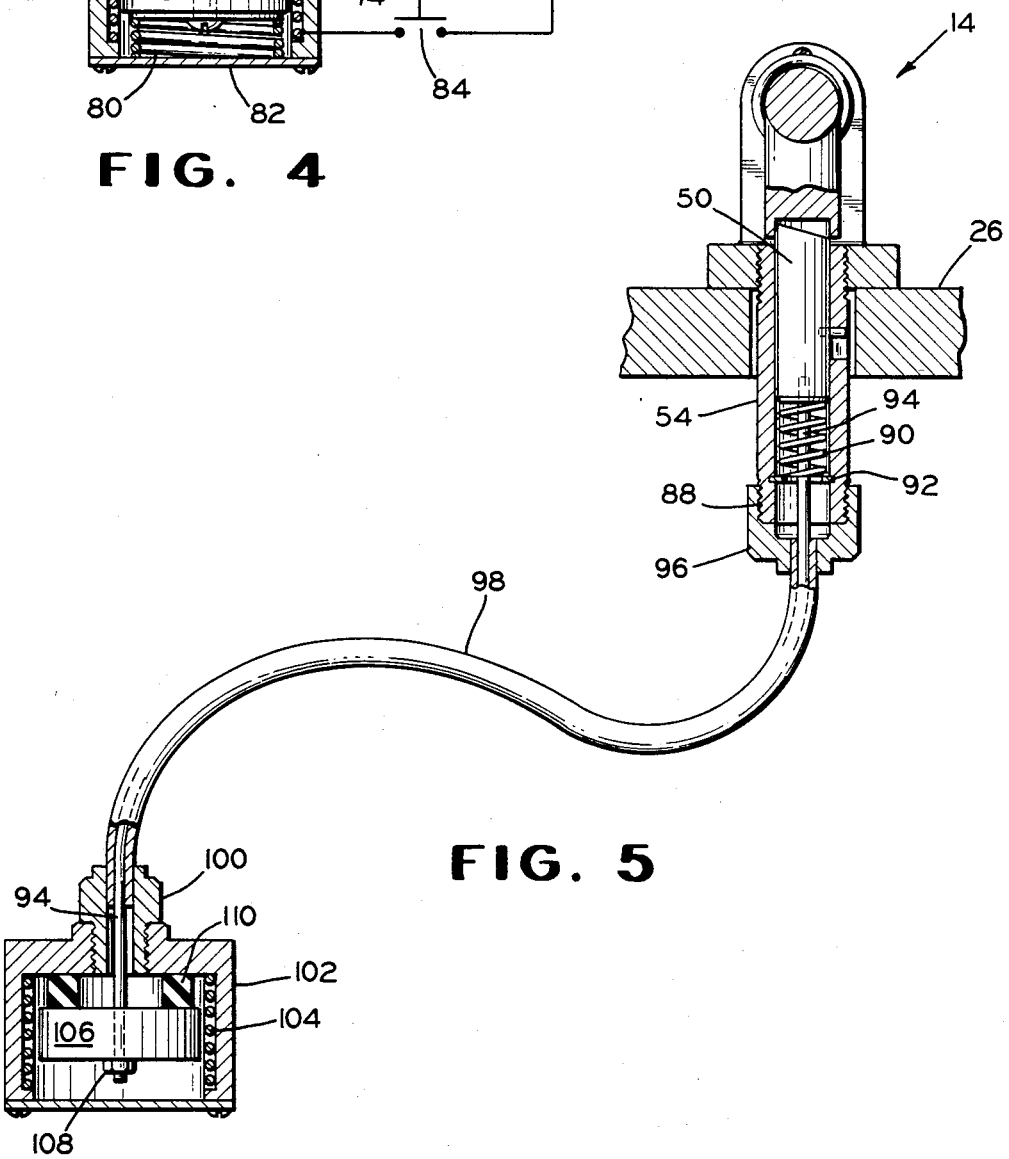
FIG. 5 is a sectional view of a modified mooring line coupler in accordance with the invention.

A modified mooring line coupler is shown in FIG. 5. This coupler basically differs from that of FIGS. 2–4 in that the solenoid is located remotely from the latch rod. This coupler requires less space below the deck 26 or other boat surface and can be employed, for example, where the cleat 14 may be near the edge of a deck and the boat hull is constructed such that there is little space below the deck. In this instance, the latch rod 50 is mounted in a modified tubular housing 54 with a smaller lower threaded end 88. A coil spring 90 is located between a lower end of the latch rod 50, which can also be shorter than that of FIGS. 2–4, and a snap ring 92 located in the housing 54. The spring 90 urges the latch rod 50 toward the latched position. A flexible cable 94 is affixed to the lower end of the latch rod 50 and extends downwardly through the spring 90 and a threaded cap 96 on the threaded end 88 of the housing 54. The cable 94 then extends through a flexible sheath or cover 98 and through a fitting 100 in a solenoid housing 102. A solenoid coil 104 in the housing 102 surrounds a solenoid core 106 through which the cable 94 extends, being affixed to the core by a nut 108 or other suitable fastener. The core 106 is urged upwardly against a resilient stop 110 by the spring 90 when the coil 104 is not actuated. When the coil 104 is actuated, by the same means as in FIG. 4, it is drawn downwardly and similarly moves the cable 94 to retract the latch rod 50 in the same manner as before.

It will be seen from the above discussion that the mooring line coupler according to the invention can embody a cleat which is substantially no bigger than a conventional boat cleat because the latch rod 50 and operating mechanism is located below the deck 26. The coupler according to the invention also has the same advantages as set forth in my earlier patent and as discussed previously.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. Apparatus for aiding in connecting a boat to a mooring unit and in casting off the boat from the mooring unit, said apparatus comprising a cleat having a base and means for mounting the base on an outer surface of the boat, said base having at least one mounting post extending upwardly therefrom, and a bar rotatably supported in an upper portion of said post and extending outwardly therefrom, a projection extending transversely from said bar for engaging a mooring line when in a first position extending toward said base and for releasing the mooring line when in a second position extending outwardly from said cleat, means for urging said projection from said first position toward said second position, a tubular housing affixed to said base and extending therebelow, releasable latch means in said tubular housing for engaging said projection and holding said projection in the first position when said projection is in the first position and when said latch means is in one position, said latch means being spaced from said projection to enable said projection to move toward the second position when said latch means is in another position, means connected to said tubular housing urging said latch means toward the one position, and remotely-controlled means for moving said latch means from the one position to the another position.

2. Apparatus according to claim 1 characterized by a second mounting post extending upwardly from said base and spaced from said first mounting post, said bar also being rotatably mounted in said second mounting post, and said projection extending from the portion of said bar between said first and second mounting posts.

3. Apparatus according to claim 1 characterized by said projection having a shallow recess in an end thereof, and said latch means comprising a rod having a slanted end received in said shallow recess when said projection is in said first position.

4. Apparatus according to claim 1 characterized by said tubular housing having resilient means therein urging said latch means from the another position toward the one position.

5. Apparatus for aiding in connecting a boat to a mooring unit and in casting off the boat from the mooring unit, said apparatus comprising a projection engaging a mooring line when in a first position and for releasing the mooring line when in a second position, means for mounting said projection on a boat and for supporting said projection for pivotal movement between said first and second positions, said mounting means comprising a bracket, a generally horizontally-extending bar pivotally carried by said bracket, said projection being affixed to and extending transversely from an intermediate portion of said bar, means for urging said projection from said first position toward said second position, releasable latch means for engaging said projection and holding said projection in the first position when said projection is in the first position and when said latch means is in one position, said latch means being spaced from said projection to enable said projection to move toward the second position when said latch means is in another position, means urging said latch means toward the one position, and remotely-controlled means mounted below said bracket for moving said latch means from the one position to the another position.

6. Apparatus according to claim 5 characterized by the mooring line having a loop engaged by said projection.

7. Apparatus for aiding in connecting a boat to a mooring unit and in casting off the boat from the mooring unit, said apparatus comprising a projection engaging a mooring line when in a first position and for releasing the mooring line when in a second position, means for mounting said projection on a boat and for supporting said projection for pivotal movement between said first and second positions, said projection having a shallow recess in an end thereof, means for urging said projection from said first position toward said second position, releasable latch means for engaging said projection and holding said projection in the first position when said projection is in the first position and when said latch means is in one position, said latch means being spaced from said projection to enable said projection to move toward the second position when said latch means is in another position, said latch means comprising a rod having a slanted end receiving in said shallow recess of said projection when said projection is in said first position, means urging said latch means toward the one position, and remotely-controlled means for moving said latch means from the one position to the another position.

8. Apparatus according to claim 7 characterized by said rod and said recess being designed such that said projection can be manually moved to said first position to first depress said rod and then enable said rod to extend into said recess to latch said projection in the first position.

* * * * *

UNITED STATES PATENT OFFICE

CERTIFICATE OF CORRECTION

PATENT NO. : 4,531,470

DATED : July 30, 1985

INVENTOR(S) : William A. Paul

It is certified that error appears in the above-identified patent and that said Letters Patent are hereby corrected as shown below:

Column 1, line 27, "it" should be --It--.

Column 2, line 48, "29" should be --28--.

In the claims:

Claim 7, line 18, "receiving" should be --received--.

Signed and Sealed this

First Day of October 1985

[SEAL]

*Attest:*

DONALD J. QUIGG

*Attesting Officer*

*Commissioner of Patents and Trademarks—Designate*